US006065944A

United States Patent [19]

Cobb

[11] Patent Number: 6,065,944

[45] Date of Patent: May 23, 2000

[54] ANNULAR PUMP

[76] Inventor: Ronald F. Cobb, 1656 Townhurst St. Suite F, Houston, Tex. 77034

[21] Appl. No.: 08/928,141

[22] Filed: Sep. 12, 1997

[51] Int. Cl.[7] ..... F04B 45/00

[52] U.S. Cl. ..... 417/394

[58] Field of Search ..... 417/394

[56] References Cited

U.S. PATENT DOCUMENTS 2,931,309 4/1960 Bower ..... 103/148

*Primary Examiner*—Timothy S. Thorpe
*Assistant Examiner*—Cheryl J. Tyler
*Attorney, Agent, or Firm*—Arthur M. Dula

[57] ABSTRACT

A pump having a semi-rigid flexible outer tube with a sealed top and a sealed bottom, check valves at the top and bottom such that the outer tube is in fluid communication with the working fluid, an inner tube concentrically disposed within the outer tube, and a controlled source that applies pressure to expand the inner tube to apply a force to the working fluid in the annulus defined by the inner and outer tubes is used to pump viscous materials and/or slurries from the bottom of small diameter wells. The tubes are made from nonmetallic, elastic materials and can be inexpensively manufactured.

8 Claims, 8 Drawing Sheets

ANNULAR PUMP

BACKGROUND OF THE INVENTION

1. Field of the Invention

The invention relates to pumps useful for moving fluids. More specifically, the present invention relates to small diameter, positive displacement, and flexible tube pumps useful for pumping viscous material and/or slurries from the bottom of small diameter wells.

2. Prior Art

A pump, is a device that expends energy to raise, transport, or compress fluids. The earliest pumps were devices for raising water, such as the Persian and Roman waterwheels and the more sophisticated Archimedes screw.

The mining operations of the Middle Ages led to development of the suction (piston) pump, many types of which are described by Georgius Agricola in De re metallica (1556). A suction pump works by atmospheric pressure; when the piston is raised, creating a partial vacuum, atmospheric pressure outside forces water into the cylinder, whence it is permitted to escape by an outlet valve. Atmospheric pressure alone can force water to a maximum height of about 34 feet (10 meters), so the force pump was developed to drain deeper mines. In the force pump the downward stroke of the piston forces water out through a side valve to a height that depends simply on the force applied to the piston.

Classification of Pumps

Pumps are classified according to the way energy is imparted to the fluid. The basic methods are (1) volumetric displacement, (2) addition of kinetic energy, and (3) use of electromagnetic force. A fluid can be displaced either mechanically or by the use of another fluid. Kinetic energy may be added to a fluid either by rotating it at high speed or by providing an impulse in the direction of flow. In order to use electromagnetic force, the fluid being pumped must be a good electrical conductor. Pumps used to transport or pressurize gases are called compressors, blowers, or fans. Pumps in which displacement is accomplished mechanically are called positive displacement pumps. Kinetic pumps impart kinetic energy to the fluid by means of a rapidly rotating impeller.

Broadly speaking, positive displacement pumps move relatively low volumes of fluid at high pressure, and kinetic pumps impel high volumes at low pressure. A certain amount of pressure is required to get the fluid to flow into the pump before additional pressure or velocity can be added. If the inlet pressure is too small, cavitation (the formation of a vacuous space in the pump, which is normally occupied by liquid) will occur. Vaporization of liquid in the suction line is a common cause of cavitation. Vapor bubbles carried into the pump with the liquid collapse when they enter a region of higher pressure, resulting in excessive noise, vibration, corrosion, and erosion. The important characteristics of a pump are the required inlet pressure, the capacity against a given total head (energy per pound due to pressure, velocity, or elevation), and the percentage efficiency for pumping a particular fluid. Pumping efficiency is much higher for mobile liquids such as water than for viscous fluids such as molasses. Since the viscosity of a liquid normally decreases as the temperature is increased, it is common industrial practice to heat very viscous liquids in order to pump them more efficiently.

Positive Displacement Pumps

Positive displacement pumps, which lift a given volume for each cycle of operation, can be divided into two main classes, reciprocating and rotary. Reciprocating pumps include piston, plunger, and diaphragm types; rotary pumps include gear, lobe, screw, vane, and cam pumps.

The plunger pump is the oldest type in common use. Piston and plunger pumps consist of a cylinder in which a piston or plunger moves back and forth. In plunger pumps the plunger moves through a stationary packed seal and is pushed into the fluid, while in piston pumps the packed seal is carried on the piston that pushes the fluid out of the cylinder. As the piston moves outward, the volume available in the cylinder increases, and fluid enters through the one-way inlet valve. As the piston moves inward, the volume available in the cylinder decreases, the pressure of the fluid increases, and the fluid is forced out through the outlet valve. The pumping rate varies from zero at the point at which the piston changes direction to a maximum when the piston is approximately halfway through its stroke. The variation in pumping rate can be reduced by using both sides of the piston to pump fluid. Pumps of this type are called double acting. Using more than one cylinder can further reduce fluctuations in pumping rate Overall changing either the reciprocating speed of the piston rod or the stroke length of the piston may vary pumping rates of piston pumps. The piston may be driven directly by steam, compressed air, or hydraulic oil or through a mechanical linkage or cam that transforms the rotary motion of a drive wheel to a reciprocating motion of the piston rod.

Piston and plunger pumps are expensive, but they are extremely reliable and durable. Piston pumps are known to have been running without repair or replacement for more than 100 years.

The action of a diaphragm pump is similar to that of a piston pump in which the piston is replaced by a pulsating flexible diaphragm. This overcomes the disadvantage of having piston packings in contact with the fluid being pumped. As in the case of piston pumps, fluid enters and leaves the pump through check valves. The diaphragm may be actuated mechanically by a piston directly attached to the diaphragm or by a fluid such as compressed air or oil.

Diaphragm pumps deliver a pulsating output of liquids or gases or a mixture of both. They are useful for pumping liquids that contain solid particles and for pumping expensive, toxic, or corrosive chemicals where leaks through packing cannot be tolerated. Diaphragm pumps can be run dry for an extended period of time. Furthermore, the pumping rate of most such pumps can be changed during operation.

In the most common type of gear pump, one of the gears is driven and the other runs free. A partial vacuum created by the unmeshing of the rotating gears, draws fluid into the pump. This fluid is then transferred to the other side of the pump between the rotating gear teeth and the fixed casing. As the rotating gears mesh together, they generate an increase in pressure that forces the fluid into the outlet line. A gear pump can discharge fluid in either direction, depending on the direction of the gear rotation.

In an internal gear pump the driven gear is a rotor with internally cut teeth, which mesh with the teeth of an externally cut idler gear, set off-center from the rotor. The crescent part of the fixed casing divides the fluid flow between the idler gear and the rotor. Gear pumps can pump liquids containing vapors or gases. Since they depend on the liquid pumped to lubricate the internal moving parts, they are not suitable for pumping gases. They deliver a constant output with negligible pulsations for a given rotor speed.

Erosion and corrosion lead to an increase in the amount of liquid slipping back through the pump. Since gear pumps are subject to clogging, they are not suitable for pumping liquids containing solid particles. Since they do not need check valves, however. they can be used to pump very viscous liquids.

Lobe pumps resemble external gear pumps, but have rotors with two, three, or four lobes in place of gears; the two rotors are both driven. Lobe pumps have a more pulsating output than external gear pumps and are less subject to wear. Lobe-type compressors are also used to pump gases; each rotor has two lobes.

In a screw pump, a helical screw rotor revolves in a fixed casing that is shaped so that cavities formed at the intake move toward the discharge as the screw rotates. As a cavity forms, a partial vacuum is created, which draws fluid into the pump. This fluid is then transferred to the other side of the pump inside the progressing cavity. The shape of the fixed casing is such that at the discharge end of the pump the cavity closes, generating can increase in pressure that forces the fluid into the outlet line.

Screw pumps can pump liquids containing vapors or solid particles. They deliver a steady output with negligible pulsations for a given rotor speed. Since screw pumps do not need inlet and outlet check valves, they can be used to pump very viscous liquids. Although screw pumps are bulky, heavy, and expensive, they are robust, slow to wear, and have an exceptionally long life.

In a sliding vane pump a rotor is mounted off-center. Rectangular vanes are positioned at regular intervals around the curved surface of the rotor. Each vane is free to move in a slot. The centrifugal force from rotation throws the vanes outward to form a seal against the fixed casing. As the rotor revolves, a partial vacuum is created at the suction side of the pump, drawing in fluid. This fluid is then transferred to the other side of the pump in the space between the rotor and the fixed casing. At the discharge side, the available volume is decreased, and the resultant increase in pressure forces the fluid into the outlet line; the pumping rate can be varied by changing the degree of eccentricity of the rotor. Vane pumps do not need inlet and outlet check valves; they can pump liquids containing vapors or gases but are not suitable for pumping liquids containing solid particles. Vane-type compressors are used to pump gases.

Vane pumps deliver a constant output with negligible pulsations for a given rotor speed. They are robust, and their vanes, easily replaced, are self-compensating for wear. Pumping capacity is not affected until the vanes are badly worn.

Progressive Cavity Pump

Progressive cavity pumps, a type of single screw pump, are used for highly viscous liquids such as peanut butter or glue, and also for liquids with significant amounts of solids such as cement or sand slurry. In this type of pump the rotor revolves inside the stator. The stator is a twisted cavity with an oval shaped cross section. It is usually made of natural or synthetic rubber, steel, or plastic. The rotor is usually steel.

Kinetic Pumps

Kinetic pumps can be divided into two classes, centrifugal and regenerative. In kinetic pumps a velocity is imparted to the fluid. Most of this velocity head is then converted to pressure head. Even though the first centrifugal pump was introduced about 1680, kinetic pumps were little used until the 20th century.

Centrifugal pumps include radial, axial, and mixed flow units. A radial flow pump is commonly referred to as a straight centrifugal pump; the most common type is the volute pump. In a volute pump, fluid enters the pump near the axis of an impeller rotating at high speed. The fluid is thrown radially outward into the pump casing. A partial vacuum is created that continuously draws more fluid into the pump.

Volute centrifugal pumps are robust and relatively inexpensive, quiet, and dependable, and their performance is relatively unaffected by corrosion and erosion. They are compact, simple in construction, and do not require inlet and outlet check valves.

Volute centrifugal pumps can pump liquids containing solid particles, but, when pumping liquids containing more than a small amount of vapor, their suction is broken by cavitation. Volute centrifugal pumps operate best when pumping relatively nonviscous liquids, and their capacity is greatly reduced when used to pump viscous liquids.

Another type of radial flow centrifugal pump is the diffiuser pump, in which, after the fluid has left the impeller, it is passed through a ring of fixed vanes that diff-use the liquid, providing a more controlled flow and a more efficient conversion of velocity head into pressure head.

In axial flow centrifugal pumps the rotor is a propeller. Fluid flows parallel to the axis. Diffusion vanes are located in the discharge port of the pump to eliminate the rotational velocity of the fluid imparted by the propeller. Axial flow compressors are also used to pump gases. In mixed flow pumps, fluid is discharged both radially and axially into a volute-type casing.

A regenerative pump is also called a turbine, or peripheral, pump. The impeller has vanes on both sides of the rim that rotate in a ringlike channel in the pump's casing. The fluid does not discharge freely from the tip of the impeller but is recirculated back to a lower point on the impeller diameter. This recirculation, or regeneration, increases the head developed. Because of close clearances, regenerative pumps cannot be used to pump liquids containing solid particles. They can pump liquids containing vapors and gases, and in fact they can pump gases provided that they contain sufficient liquid to seal the close clearances. Regenerative pumps are suitable only for pumping mobile liquids.

Electromagnetic Pumps

These can be used only to pump fluids that are good electrical conductors. The pipe carrying the fluid is placed in a magnetic field and a current passed crosswise through the fluid, so that it is subjected to an electromagnetic force in the direction of the flow. The current and the field can be produced in a variety of ways. The principle of the electromagnetic pump is the same as that of the electric motor. Electromagnetic pumps are used for pumping liquid metals, which are used for cooling nuclear reactors.

Other Types of Pumps

Gas lifts are used to raise liquids from the bottoms of wells. Compressed gas is introduced into the liquid near the bottom of the well. The resulting mixture of gas and liquid is lighter and more buoyant than the liquid alone so that the mixture rises and is discharged. Gas lifts have no moving parts, and they can be used to pump liquids containing solid particles. Although air, or gas, lifts are now little-used, they were once widely used for pumping water, brine, and oil.

In the jet ejector pump, fluid passes through a venturi nozzle and develops a suction that causes a second stream of fluid to be entrained. In the aspirator pump, water flows through a venturi nozzle and develops suction for drawing in air. Steam ejectors are widely used for pumping large volumes of vapors and gases at low pressures. Steam at high velocity enters the main body of the pump and transfers some of its momentum to the gas, which is sucked in from the inlet line. A mixture of steam and gas enters the main venturi nozzle known as the diffuser. Kinetic energy is converted to pressure energy, and the mixture of steam and gas is compressed. Thus, energy in the steam is used to compress gas from a low to a higher pressure. Jet ejector pumps have been used since about 1850.

Peristaltic pumps are used to pump blood, drugs or chemicals. In a peristaltic pump the pumped fluid is contained in a flexible tube. Pressure applied to the tube causes the fluid to move through check valves. This type of pump is the closest prior art to the present invention known to the inventor.

U.S. Pat. No. 3,862,629 teaches a series of inflatable chambers connected in series by valve means for producing pressure pulses by the inflation and deflation of the chambers. Although this invention is principally usefull for providing a mechanical massage to improve secondary blood flow, one embodiment of this invention is a peristaltic pump wherein the pressure chamber place force on a flexible tube to move a fluid disposed therein.

U.S. Pat. No. 4,165,954 teaches a linear peristaltic pump. A pump arm applies a force to a flexible tube. A roller intermittently contacts the flexible tube causing a quantity of liquid to be peristaltically moved within the tube.

U.S. Pat. No. 4,606,710 teaches a peristaltic pump wherein an outer casing rotatably receives a cage carrying rollers for placing force on a flexible tube interposed between the casing and the rollers, whereby fluid is moved in the tube.

The Liotta-VAD ProCor Model 1 intracorporeal blood pump is a pneumatically driven blood pump that uses symmetrically opposed dual pusher plates to deform a flexible blood chamber in a circular-rolling fold. This heart assist device uses an exterior set of pneumatic chambers to place force on a blood chamber thereby moving the blood. Liotta D., Alvarex C. B. and CONICET-PROCOAR Investigators, Chronic Heart Assist System, Assisted Circulation IV, pp. 217–232, 1995. Editor, R. Unger-Verlag Berlin.

Pumps taught by the prior art are difficult or impossible to fit into the small diameter boreholes of wells, as is often desirable in ecological rehabilitation on subsurface pollution. Suction pumps can be used, but not for deep wells or with low vapor pressure liquids. Non positive displacement pumps also have difficulty pumping viscous liquids or liquid/solid slurries.

SUMMARY OF THE INVENTION

The present invention is a pump comprising a semi rigid flexible outer tube having a sealed top and a sealed bottom, check valves at said top and bottom allowing fluid communication with a working fluid, an inner tube concentrically disposed within said outer tube and a means for applying fluid pressure to expand said inner tube to apply force to the working fluid in the annulus defined by said inner and outer tubes. whereby the working fluid is moved through the check valves.

It is a purpose of the present invention to provide a pump that can lift fluids from the bottom of small diameter wells.

Another purpose of the present invention is to provide a pump that can be used horizontally to pump liquids contaminated with solids from sumps and ditches.

Yet another purpose of the present invention is to provide a pump that can move fluids in laminar flow to prevent damage to fluids such as biological materials and cosmetics.

Another purpose of the present invention is to provide a pump that can move high viscosity slurries in the settled solids found in hydrocarbon processing and sewage treatment.

A purpose of the present invention is to provide a pump that can be used totally immersed in chemically aggressive environments and in extreme temperatures such as to remove the black sludge that accumulates at the bottom of molten sulfur pits while the pits are in operation.

Another purpose of the present invention is to provide a pump that can be made of biologically acceptable components for use in the human body.

BRIEF DESCRIPTION OF THE DRAWINGS

These and other advantages of the present invention may be more clearly understood with reference to the specification and the drawings in which.

DESCRIPTION OF THE PREFERRED EMBODIMENT

Figure 1A:
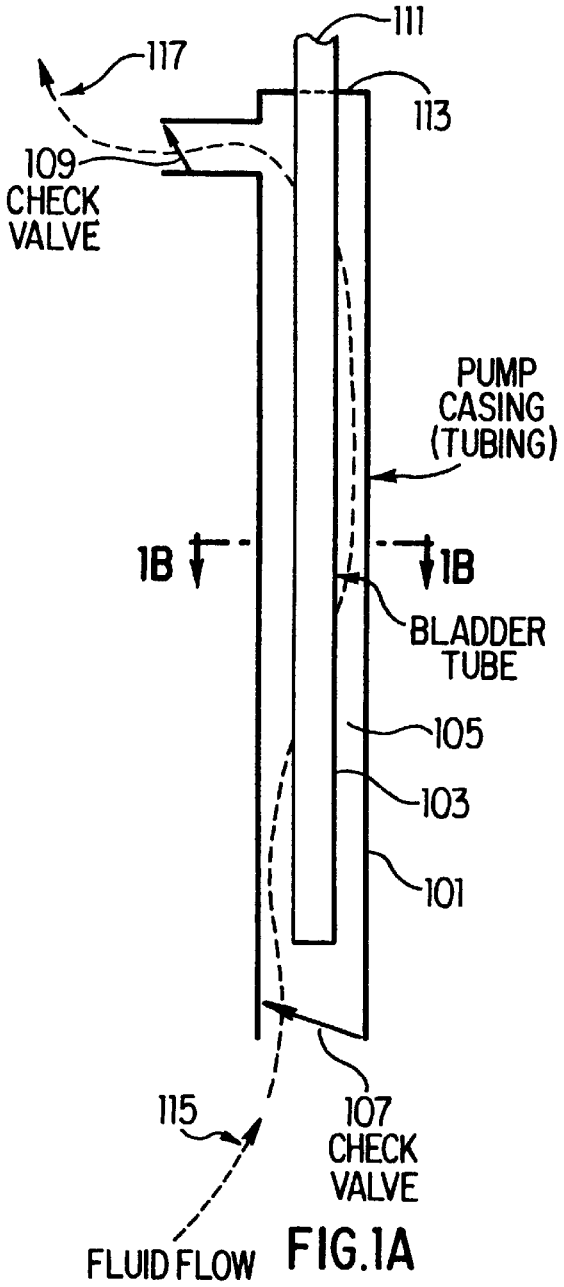
FIG. 1 shows a cross section through a simple embodiment of the pump taught by the present invention.
Figure 1B:
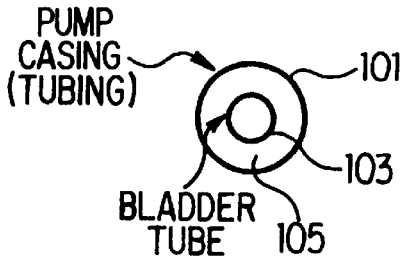

FIG. 1 shows a longitudinal and cross sectional view of the present invention. In FIG. 1 outer tube 101 and inner tube 103 define an annulus 105. Tube 101 has a lower inlet check valve 107 that allows working fluid to flow into annulus 105. Tube 101 also has an upper outlet check valve 109 that allows working fluid to flow out of annulus 105. Inner tube 103 penetrates the upper end 113 of tube 101. Inner tube 103 is in fluid communication through its upper end 111 with a source of controllable fluid pressure, not shown.

Inlet check valve 107 and outlet check valve 109 may be any check valve currently used with positive displacement pumps. Use of a section of thinner wall flex tubing at the bottom of tube 101 can function as the bottom inlet check valve in many applications. Thus the check valve may be made of the same plastic material as the inner and outer tubes. This can make the pump very inexpensive to build. Outer tube 101 and inner tube 103 may be any semi-rigid plastic tubing capable of withstanding a fall vacuum. These tubes may be made of highly chemically resistant materials such as Kynar, Viton or Teflon. No metallic parts are required. The tubes 101 and 103 may be of small diameter, allowing the pump to be inserted into locations that would be inaccessible to other pumps.

Functionally, fluid pressure is introduced into inner tube 103, causing it to expand. This compresses the working fluid in annulus 105 and expels some of the working fluid out of upper outlet check valve 109, as is shown in FIG. 1 by arrow 117. The fluid pressure in tube 103 is then reduced. This reduces the pressure on the working fluid in annulus 105 and draws more working fluid into annulus 105 through lower inlet check valve 107 as is shown in FIG. 1 by arrow 115.

It may be desirable to place a small tube or string in annulus 105 to prevent complete closure of the annulus during the pump's operation.

The fluid used to pressurize inner tube 103 can be anything from common gases to liquid blends designed to be compatible with the intended service. In general highest efficiency is obtained with low viscosity fluids having a specific gravity similar to the material to be pumped. This is particularly true for pumps over 20 feet long intended for vertical pumping.

Pump performance characteristics can be affected by many factors. The primary design parameters are overall length, internal and external diameters of the outer and inner tubes and the elastimeric characteristics of each tube. The present invention shares most of the characteristics of positive displacement pumps. Differences are due to the "long thin" nature of the invention's design, which places the pump suction at the point of pickup and the discharge closer to final discharge. The pumps taught by the preferred embodiment of the present invention are capable of near perfect vacuum suctions and discharge pressures are limited only by the strength of the outer tube and valving. The pump is inherently inexpensive to manufacture, easy to clean, easy to repair and easily inspected if the outer tubing is clear. Pumps made according to the present invention can vary in cross section from round to any practical shape (oval, square, triangle, or irregular). Pump length is limited only by the practical limitations of hydraulic flow through the interior of the inner tube.

Figure 2:
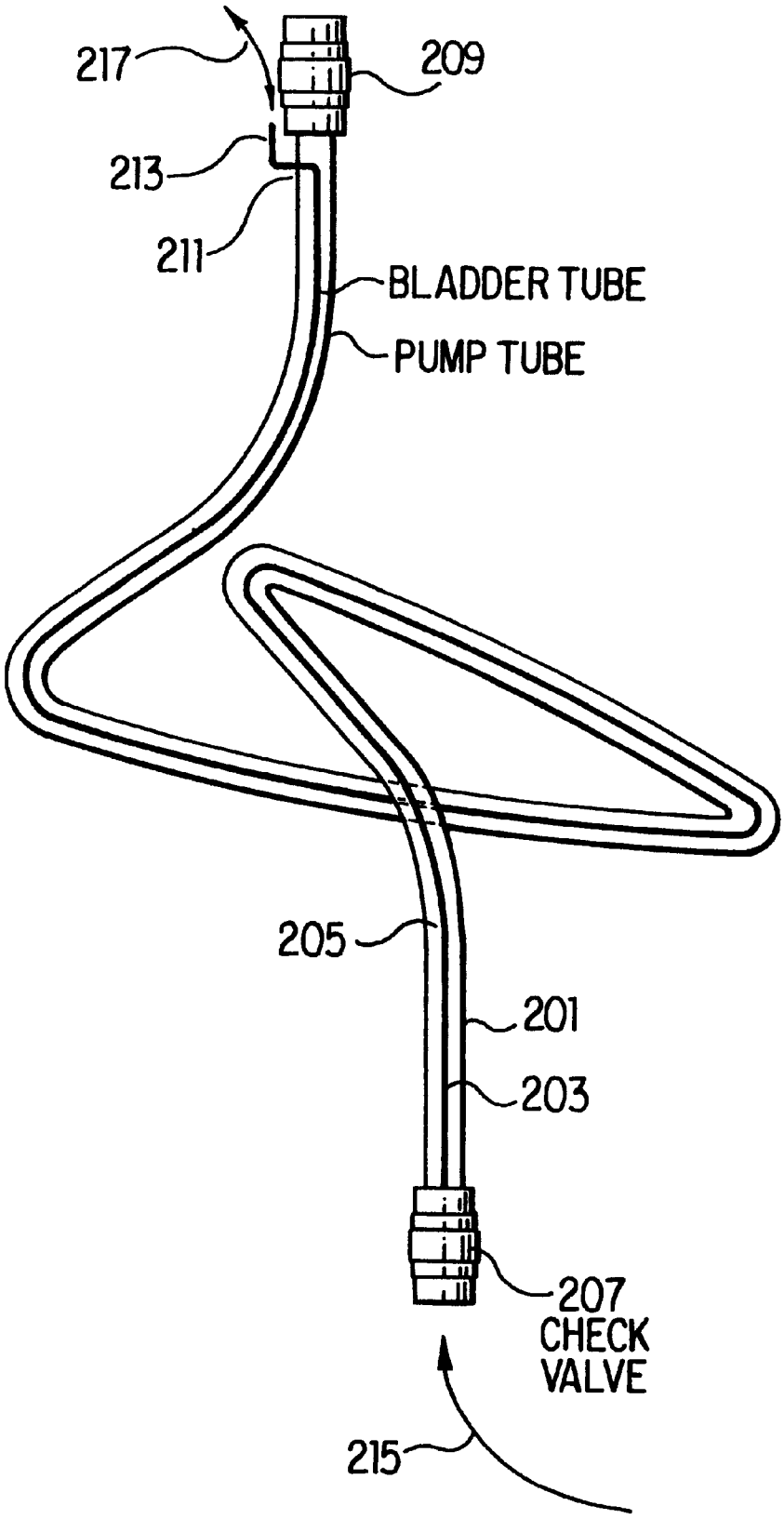
FIG. 2 shows a flexible embodiment of the present invention.

FIG. 2 shows a long thin embodiment of the pump taught by the present invention. FIG. 2 shows how the present invention can operate even when it is long, thin and bent through several sharp angles.

In FIG. 2, outer tube 201 and inner tube 203 define annulus 205. Outer tube 201 is sealed at its upper end with upper outlet check valve 209. Outer tube 201 is sealed at its lower end by lower inlet check valve 207. Inner tube 203 penetrates the upper end of tube 201 at position 211 and is in fluid communication by outlet 213 with a controllable source of fluid pressure, not shown. Inner tube 203 is sealed at one end and attached mechanically by any convenient means near the end of tube 201.

Functionally, in FIG. 2, fluid pressure is introduced from a controllable source, not shown, through inlet 213 to inner tube 203 as is shown in FIG. 2 by arrow 217. This pressure makes tube 203 expand applying force on the working fluid in annulus 205. This force moves part of the working fluid through the upper outlet check valve 209. The pressure in inner tube 203 is then reduced. This lowers the pressure on the working fluid in annulus 205, whereby working fluid is drawn through lower inlet check valve 207 as is shown in FIG. 2 by arrow 215. This cycle is then repeated as required to make the pump operate at the desired rate of flow.

Figure 3:
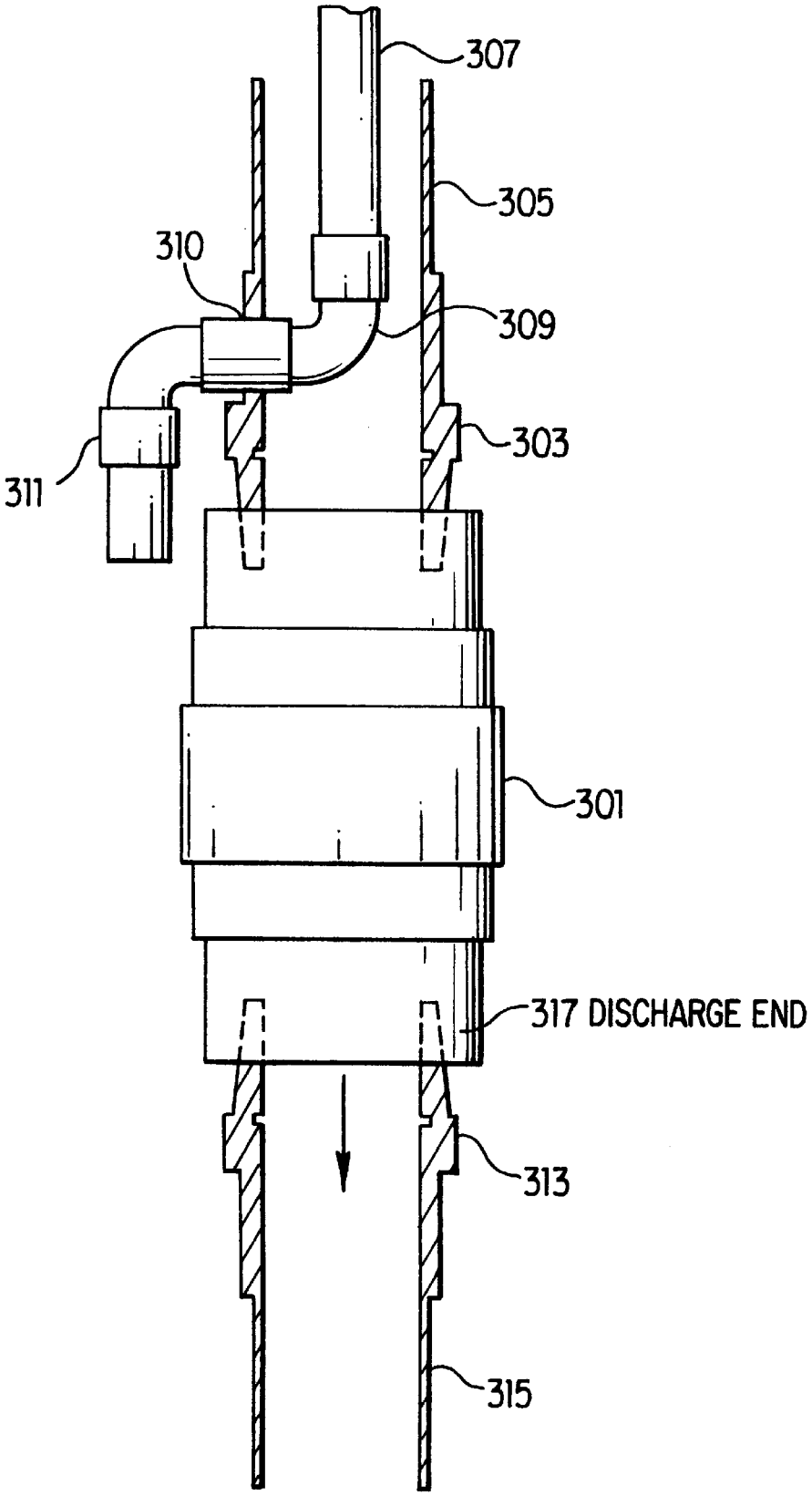
FIG. 3 shows a detail of the discharge end of the embodiment of the invention shown in FIG. 2.

FIG. 3 shows a partial cross section detail of the discharge end of the pump shown in FIG. 2.

In FIG. 3, a check valve 301 has an inlet attachment fitting 303 and an outlet attachment fitting 313. Outer tube 305 is disposed in close fitting engagement and hermetically sealed, by adhesive or any other well know means, to valve inlet fitting 303. Inner tube 307 is hermetically sealed to elbow fitting 309 that penetrates fitting 303 through opening 310. Elbow 309 is hermetically sealed to and in fluid communication with elbow fitting 311. Discharge end fitting 313 is shown attached to and in fluid communication with output tube 315. The lines and valves may be made of any material capable of physically and chemically tolerating the environment of the working fluid.

Figure 4:
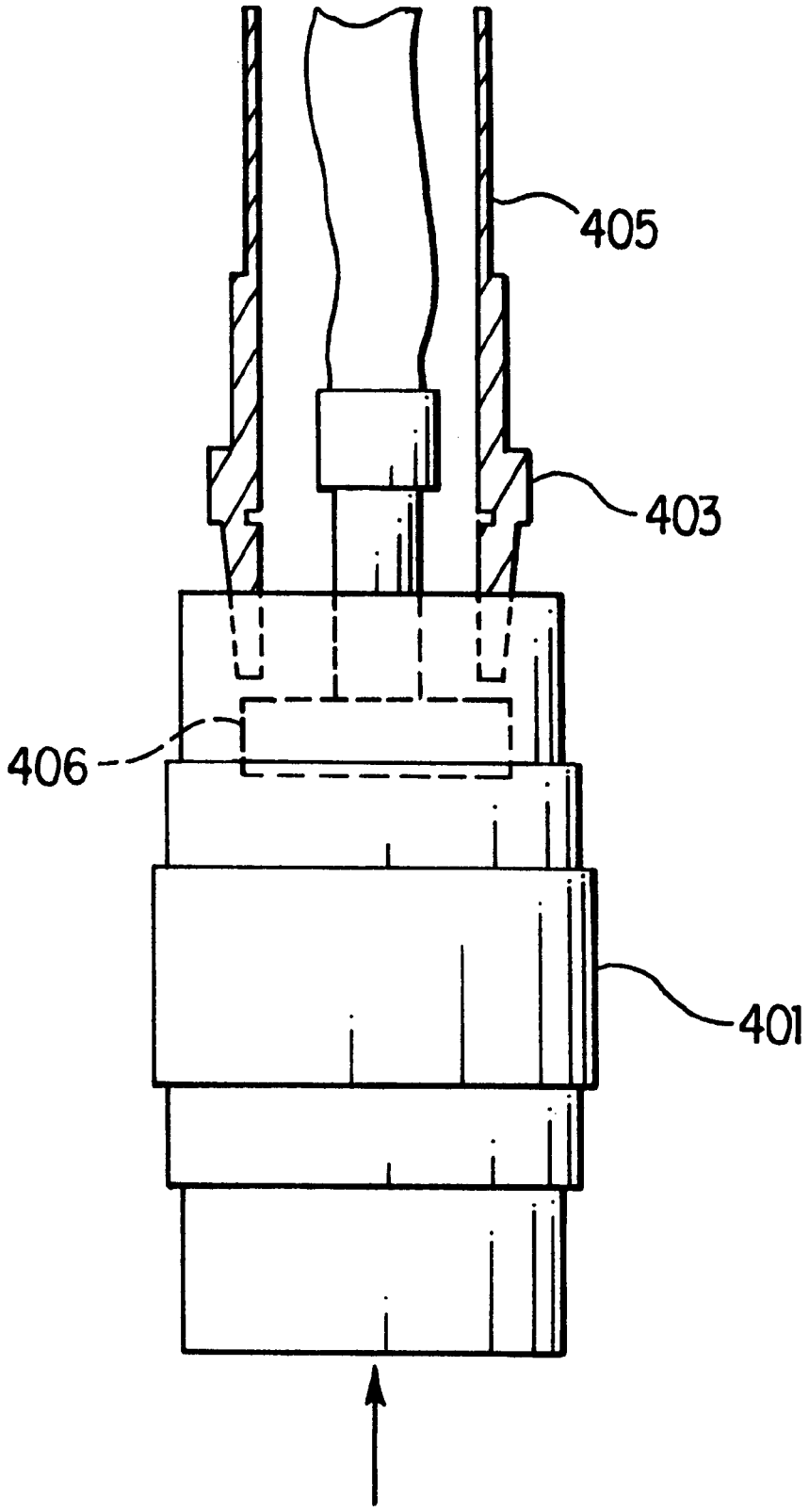
FIG. 4 shows a detail of the inlet end of the embodiment of the invention shown in FIG. 2.

FIG. 4 shows a partial cross section detail of the inlet end of the pump shown in FIG. 2.

Figure 5:
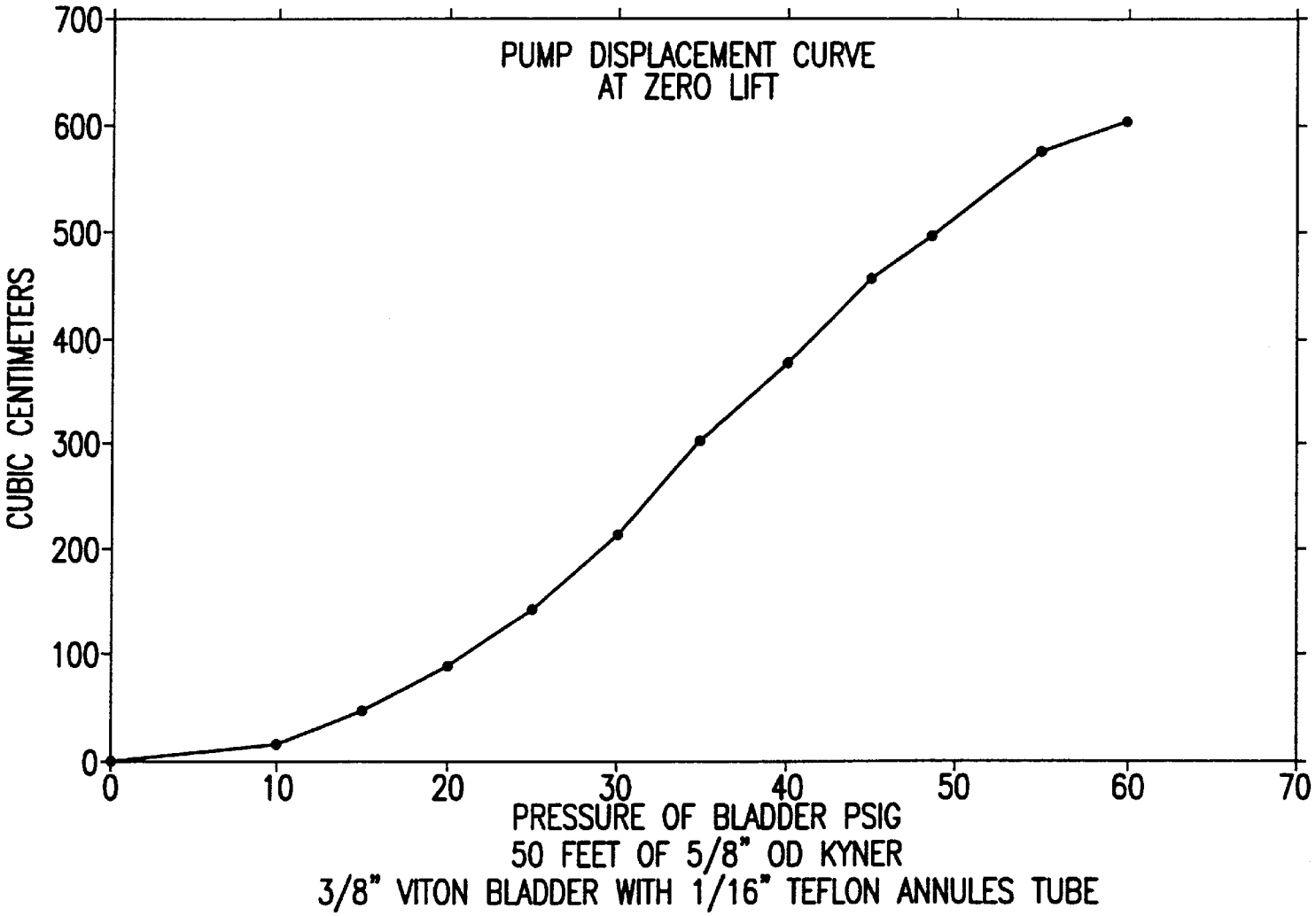
FIG. 5 shows a pressure vs. volume curve of the pump shown in FIG. 2.

In FIG. 4, check valve 401 has an outlet fitting 403 that is in exterior close fitting engagement and fluid communication with outer tube 405. The bond between fitting 403 and tube 405 is hermetic and may be made by adhesive or in any other way well known to those with skill in the art or mechanical engineering. The lines and valves may be made of any material capable of physically and chemically tolerating the environment of the working fluid. Fitting 406 describes one of many ways to supply a method of attaching/anchoring the bladder tube to the end of the pump, FIG. 5 shows the pressure vs. volume curve for the pump taught by the embodiment of the present invention shown in FIG. 2.

Figure 6:
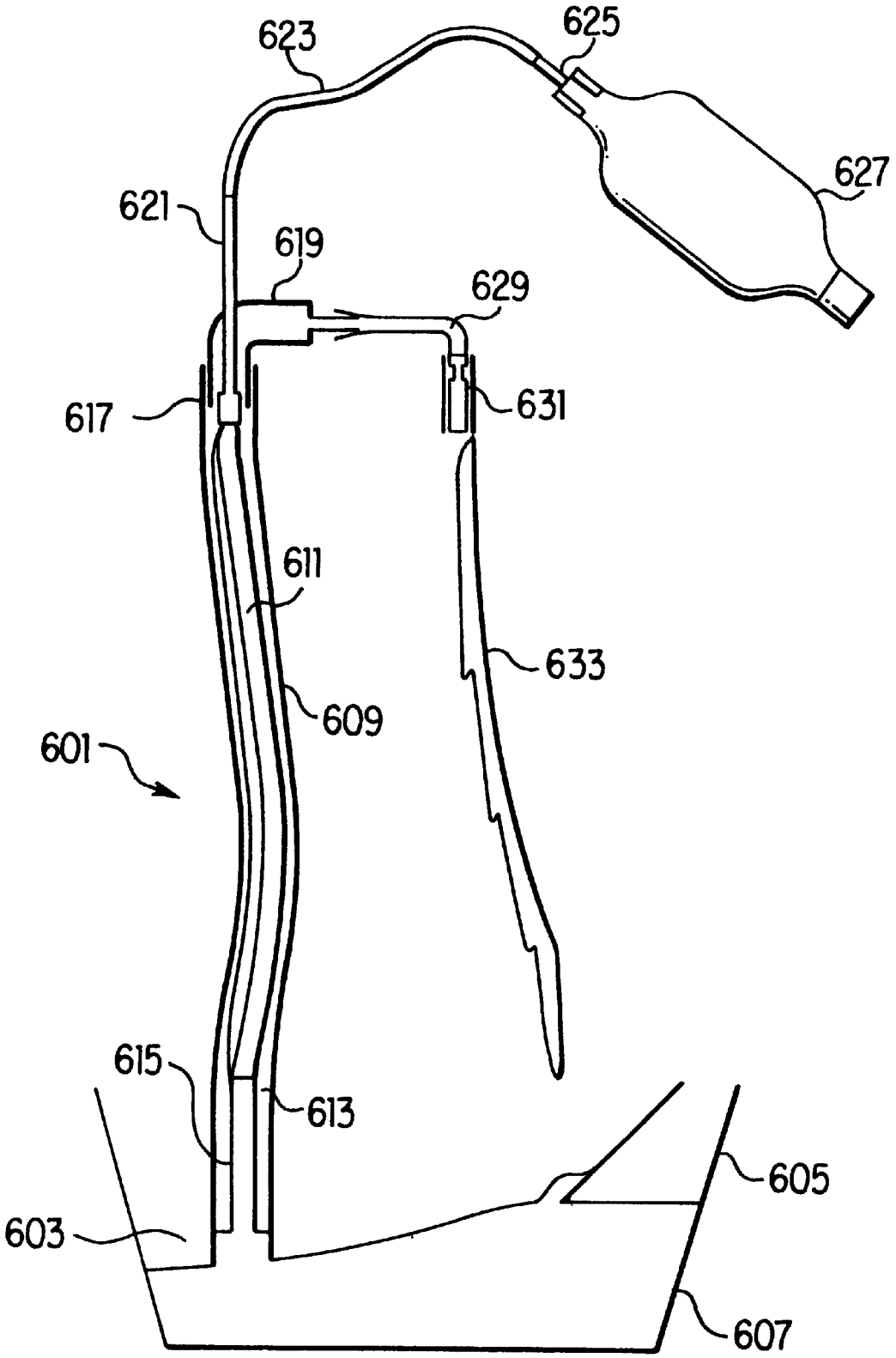
FIG. 6 shows an embodiment of the invention with a manual pressure source used to pump liquid.

FIG. 6 shows another embodiment of the pump taught by the present invention. In FIG. 6, pump 601 is shown with its lower end input end 603 in a sump 605 that is filled with thick sludge 607. Pump 601 has an outer tube 609 and an inner tube 611 that define annulus 613. The lower end of inner tube 611 is mechanically attached to, but not in fluid communication with lower inlet check valve 615 at the inlet end 603 of outer tube 601. The upper end of inner tube 611 is attached to and in fluid communication with connector tube 621. The upper end 617 of outer tube 601 is attached to and in fluid communication with elbow 619. Elbow 619 is attached to and in fluid communication with outlet tube 629. Outlet tube 629 is attached to and in fluid communication with outlet check valve 631. Connector tube 621 penetrates elbow 619 and is attached to and in fluid communication with pressure line 623. Pressure line 623 is attached to and in fluid communication with bottle outlet 625 of squeeze bottle 627.

Functionally, in FIG. 6, an operator, not shown, squeezes pressure bottle 627. This puts pressure in inner tube 611, which causes tube 611 to expand. The expansion of tube 611 applies force to the working fluid in annulus 613 forcing some of the working fluid up through elbow 619 and outlet check valve 631 where it exits the pump as effluent stream 633. The pressure on bottle 627 is then relaxed, which reduces the pressure on the working fluid and causes suction to draw more working fluid into the pump through inlet check valve 615.

Figure 7:
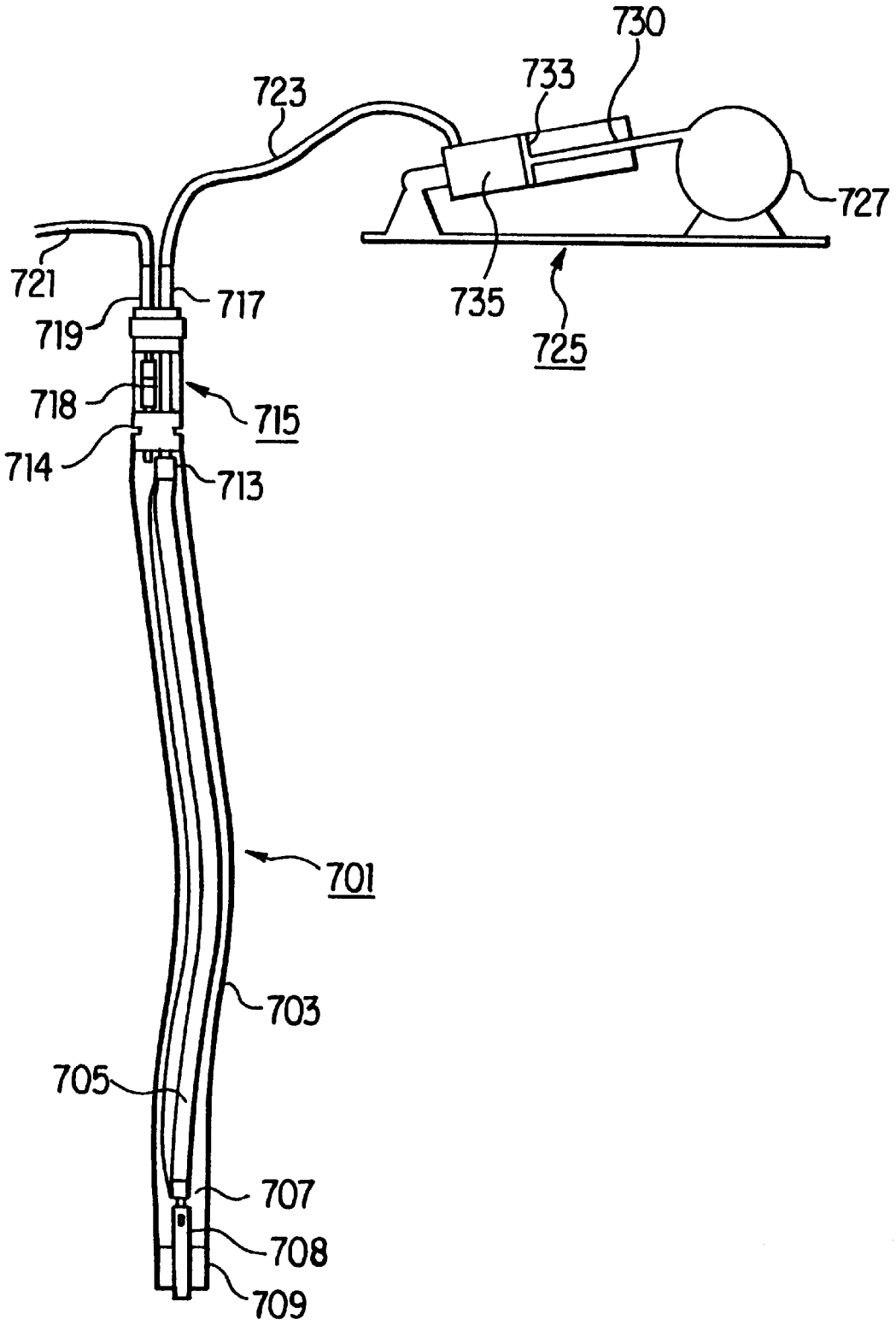
FIG. 7 shows an embodiment of the invention operated by a mechanical pressure source.

FIG. 7 shows another embodiment of the pump taught by the present invention. In FIG. 7, pump 701 has an outer tube 703 and an inner tube 705 that define annulus 707. Outer tube 703 is sealed at its upper end by upper plug 714 and at its lower end by lower plug 709.

Lower plug 709 is penetrated by lower inlet check valve 708. The lower end of inner tube 705 is mechanically attached to the top of check valve 708, but is not in fluid communication with the valve.

Upper plug 714 is penetrated by connection line 717 and upper outlet check valve 718 in valve section 715. The upper end of inner tube 705 is attached to and in fluid communication with connection line 717. Line 717 is attached to and in fluid communication with line 723 that is in turn connected to and in fluid communication with reciprocating fluid pump 725. Check valve 718 is in fluid communication with and attached at its output side 719 to output line 721.

Pump 725 comprises a rotary prime mover 727 connected via connecting rod 730 to a piston 733 disposed within a cylinder 735, said cylinder being in fluid communication with pressure line 723 and thence with inner tube 705.

Functionally, prime mover 727 causes piston 733 to move back and forth within cylinder 735 which applies varying pressure to the interior of inner tube 705, causing it to expand and contract. As tube 705 expands, it applies force to the working fluid in annulus 707, which forces some of the working fluid through check valve 718 and out line 721. When inner tube 705 contracts, more working fluid is drawn into the pump through inlet check valve 708, as was described in connection with FIGS. 1, 2 and 6, above.

Figure 8:
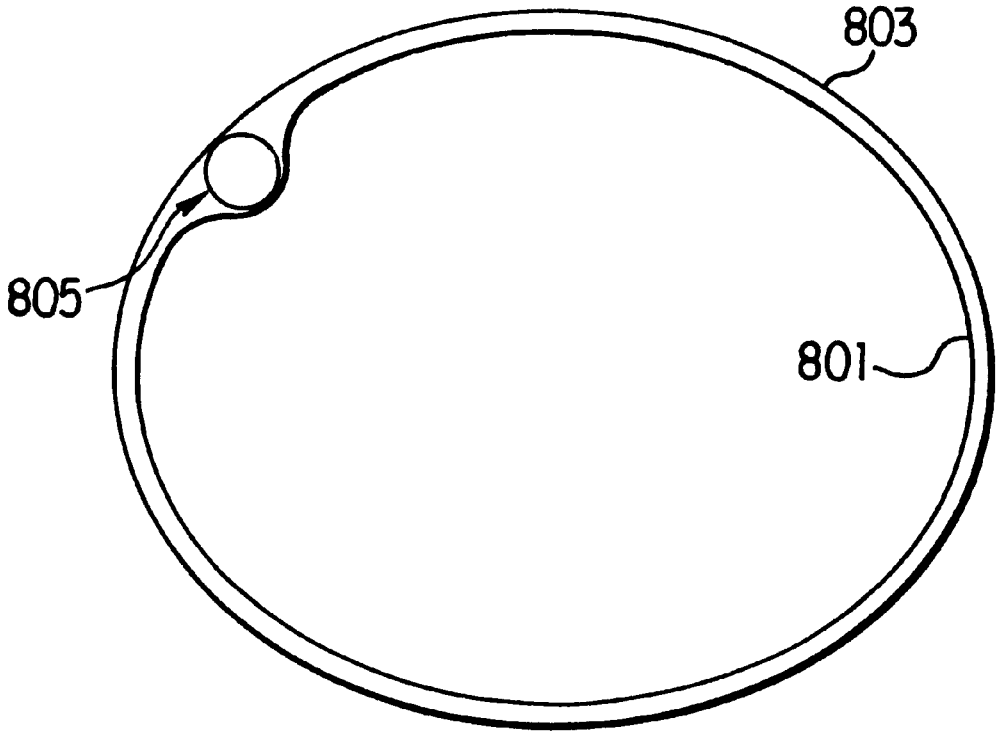
FIG. 8 shows an embodiment of the present invention wherein the inner and outer tubes are separately coaxial within a third tube.

FIG. 8 shows a pump according to the present invention wherein the inner tube 801 and outer tube 803 are separately coaxial within a third tube 805.

The present invention has been described in this specification in terms of its preferred embodiments, these being the best embodiment of the invention known to the inventor at the time this specification was prepared. The present invention is, however, broader than these specific embodiments and should be limited only by the appended claims.

I claim:

1. A pump comprising, an outer nonmetallic elastic flexible tube having an inlet end and an outlet end, an inner nonmetallic elastic flexible tube having a sealed end and an inlet end, said inner flexible tube being disposed within said outer tube forming an annulus, an inlet check valve having an inlet and an outlet, said outlet of said inlet check valve being attached to the inlet end of said outer flexible tube and being in fluid communication with said annulus, an outlet check valve having an inlet and an outlet, said inlet of said outlet check valve being attached to the outlet end of said outer flexible tube and being in fluid communication with said annulus, pressure means for applying a varying pressure to the inlet end of said inner flexible tube, said varying pressure having a high pressure and a low pressure being sufficient to cause said inner flexible tube to expand and contract.

2. A pump as in claim 1 wherein said inner and said outer tubes are capable of withstanding a full vacuum.

3. A pump as in claim 2 wherein said inner and said outer tubes are made of chemically resistant materials.

4. A pump as in claim 1 wherein the length of said inner and said outer tubes is more than ten times the diameter of the outer tube.

5. A pump as in claim 1 including a spacer means for separating said inner and said outer tubes when said varying pressure is low pressure.

6. A pump as in claim 5 wherein said spacer means is a cord disposed between said inner tube and said outer tube along substantially the entire length of the annulus.

7. A pump as in claim 1 wherein the sealed end of said inner tube is attached to the inlet check valve.

8. A pump as in claim 1 wherein the inner and outer tubes are separately coaxial within a third tube.

* * * * *